US008151887B2

(12) United States Patent
DCosta et al.

(10) Patent No.: US 8,151,887 B2
(45) Date of Patent: Apr. 10, 2012

(54) LUBRICATOR VALVE

(75) Inventors: Deepak J. DCosta, Houston, TX (US); Allyn Pratt, Meadows Place, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 640 days.

(21) Appl. No.: 11/851,173

(22) Filed: Sep. 6, 2007

(65) Prior Publication Data

US 2009/0065212 A1 Mar. 12, 2009

(51) Int. Cl.
*E21B 34/00* (2006.01)

(52) U.S. Cl. ..... 166/319; 166/368; 166/373; 166/332.3; 251/315.01

(58) Field of Classification Search ..... 166/368, 166/339, 344, 345, 352, 367, 373–375, 381, 166/386, 86.1, 316, 319, 332.2, 332.3; 251/315.01
See application file for complete search history.

(56) References Cited

U.S. PATENT DOCUMENTS

| | | | | | |
|---|---|---|---|---|---|
| 3,815,675 | A * | 6/1974 | Peters | 166/72 |
| 3,870,101 | A * | 3/1975 | Helmus | 166/363 |
| 3,939,913 | A * | 2/1976 | Mott | 166/375 |
| 4,197,879 | A * | 4/1980 | Young | 137/629 |
| 4,253,525 | A * | 3/1981 | Young | 166/336 |
| 4,368,871 | A * | 1/1983 | Young | 251/58 |
| 4,436,157 | A * | 3/1984 | Brooks | 166/344 |
| 4,476,933 | A * | 10/1984 | Brooks | 166/324 |
| 4,658,904 | A * | 4/1987 | Doremus et al. | 166/336 |
| 5,782,304 | A * | 7/1998 | Garcia-Soule et al. | 166/356 |
| 5,857,523 | A | 1/1999 | Edwards | |
| 5,884,703 | A * | 3/1999 | Garcia-Soule et al. | 166/356 |
| 5,884,707 | A * | 3/1999 | Garcia-Soule et al. | 166/356 |
| 5,884,708 | A * | 3/1999 | Garcia-Soule et al. | 166/356 |
| 5,894,890 | A * | 4/1999 | Garcia-Soule et al. | 166/356 |
| 6,250,383 | B1 * | 6/2001 | Patel | 166/70 |
| 6,401,826 | B2 * | 6/2002 | Patel | 166/375 |
| 6,609,571 | B2 | 8/2003 | Nice et al. | |
| 7,163,064 | B2 * | 1/2007 | Moncus et al. | 166/379 |
| 2003/0106588 | A1 | 6/2003 | Zahe | |
| 2004/0069496 | A1 * | 4/2004 | Hosie et al. | 166/373 |
| 2006/0060360 | A1 * | 3/2006 | Moncus et al. | 166/386 |
| 2007/0119595 | A1 | 5/2007 | Carlsen et al. | |
| 2007/0204999 | A1 * | 9/2007 | Cowie et al. | 166/368 |

* cited by examiner

*Primary Examiner* — Thomas Beach
*Assistant Examiner* — Matthew Buck
(74) *Attorney, Agent, or Firm* — Chadwick A. Sullivan

(57) ABSTRACT

A lubricator valve assembly adapted for connection in a pipe string for use in a well includes a tubular valve body having a bore formed longitudinally therethrough; a valve seat connected to the valve body and in communication with the bore; a valve element mounted in the bore and rotatable with respect to the valve seat between positions opening and closing the bore; an operator in connection between the valve element and a hydraulic control system, the operator moving the valve element between the open and close bore positions in response to the hydraulic control system; and a system for opening the valve element upon failure of the hydraulic system.

15 Claims, 2 Drawing Sheets

LUBRICATOR VALVE

TECHNICAL FIELD

The present invention relates in general to wellbore operations and more specifically to a lubricator valve having pump-through functionality for restoring access to the wellbore during a closed valve failure.

BACKGROUND

Lubricator valves commonly located in pipe strings above the subsea test tree and below the flowhead are remotely controlled by hydraulic lines in a manner such that the operator can introduce wireline or coiled tubing tools into the well. It is highly desirable to provide a mechanism to pump-through or open the valve upon the failure of the hydraulic system or control system for the valve.

Therefore, it is a desire to provide a lubricator valve with pump-through functionality.

SUMMARY

In view of the foregoing and other considerations, the present invention relates to a lubricator valve with pump-through functionality.

Accordingly, a lubricator valve assembly adapted for connection in a pipe string for use in a well includes a tubular valve body having a bore formed longitudinally therethrough; a valve seat connected to the valve body and in communication with the bore; a valve element mounted in the bore and rotatable with respect to the valve seat between positions opening and closing the bore; an operator in connection between the valve element and a hydraulic control system, the operator moving the valve element between the open and close bore positions in response to the hydraulic control system; and a system for opening the valve element upon failure of the hydraulic system.

In a well completion having a pipe string extending from a wellhead into a wellbore and a lubricator valve connected in the pipe string for intervening in the wellbore, the lubricator valve includes a body having a longitudinal bore; a valve seat; a ball element mounted in the bore and rotatable with respect to the valve seat between positions opening and closing the bore, the valve seat positioned below the ball element relative to the wellhead; an operator in connection between the ball element and a hydraulic control system, the operator moving the ball element between the open and close bore positions in response to the hydraulic control system, the operator not in fluid communication with the bore; and a means for pumping-through the lubricator valve when the ball element is in the closed position, the pump-through means including a pump-through piston having a first end connected to the operator and a second end in fluid communication with the bore above the ball element and a counter piston having an end connected to the operator and a second end in fluid communication with the bore below the ball element.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
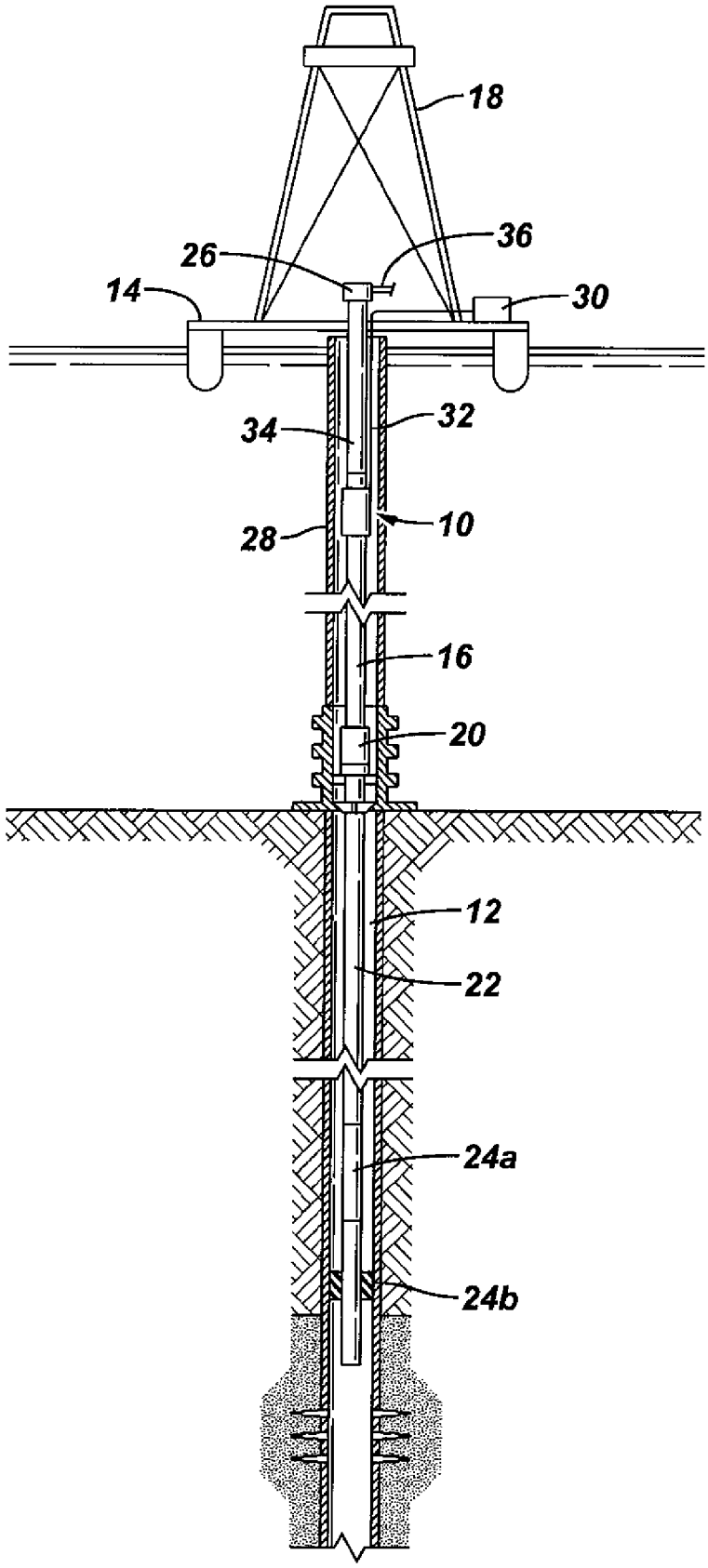
FIG. 1 is a schematic of an offshore well utilizing a lubricator valve of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic of an offshore well 12 utilizing a lubricator valve 10 of the present invention. Well 12 is being drilled from a vessel 14 such as a platform, rig or ship. A pipe string 16 extends from the vicinity of the rig floor of a derrick 18 to a subsea control valve 20. A lower pipe string 22 is suspended from the control valve 20 and may have connected thereto a series of well tools such as a tester valve 24*a* and a packer 24*b*. A wellhead 26 is connected to the upper end of pipe string 16 at the rig floor of derrick 18.

In accordance with the present invention, lubricator valve 10 is connected in pipe string 16 about 60 to 150 feet (18 to 47 meters) below the rotary inside of the riser 28. Lubricator valve 10 is hydraulically controlled from a station 30 through two hydraulic lines 32 that are selectively pressurized to cause valve 10 to open and close as desired. Lubricator valve 10 enables the top pipe string portion 34 to be used as a lubricator during intervention operations when running tool strings 36 such as wireline or coil tubing strings.

In some embodiments, lubricator valve 10 is a fail-as-is valve with pump-through capability. By "fail-as-is" it is meant that valve 10 remains in its actuated position, open or closed, upon failure of the hydraulic system. The pump-through functionality of valve 10 is the mechanism for restoring access to well 12 when valve 10 fails in the closed position. In embodiments of the present invention the valve may be opened by above ball bore pressure acting on a piston.

The pump-through piston alone facilitates pump-through at high ball pressure differentials between the pressure above the ball and below the ball in the range of 600-8,400 psi. It is further identified that pump-through functionality can be achieved for low differential ball pressure, for example 300 to 500 psi, by the addition of a balance piston in addition to the pump-through piston.

Figure 2:
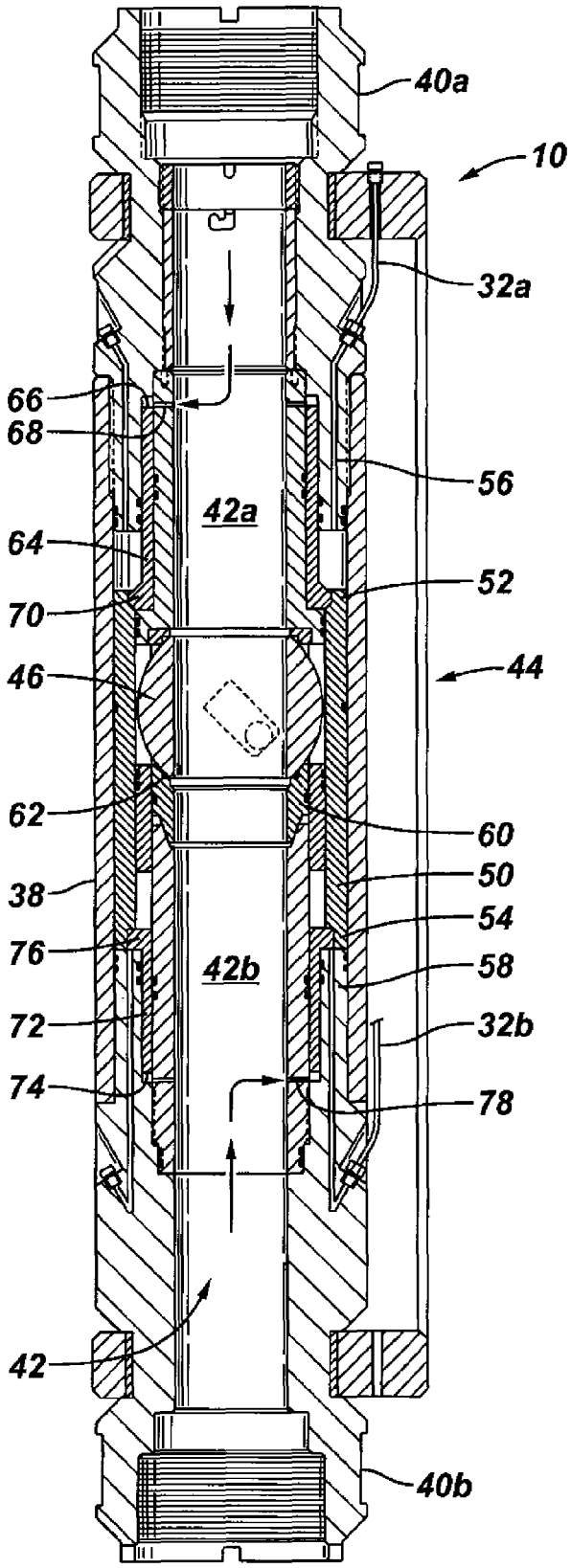
FIG. 2 is a partial cross-sectional view of a lubricator valve of the present invention.

Refer now to FIG. 2 wherein a partial cross-sectional view of an embodiment of lubricator valve 10 is provided. Lubricator valve 10 includes a body or housing 38 including upper and lower subs 40*a*, 40*b*, a central flow passage or bore 42, and a valve assembly 44 for controlling fluid flow through bore 42. Subs 40 are adapted for connecting lubricator valve 10 in pipe string 16. Upper and lower centralizers may be provided to protect the hydraulic lines 32 that run along side of lubricator 10.

Valve assembly 44 includes a full-opening element such as ball element 46 for controlling fluid flow. Ball element 46 is connected to body 38 and positioned such that bore 42 is divided into an upper bore 42*a* and a lower bore 42*b*. As is known in the art, upper bore 42*a* is the portion of the bore between the surface or wellhead 26 and ball element 46 and lower bore 42*b* is on the other side of ball element 46.

Ball valve assembly 44 includes a seal retainer 60 connected within tubular body and positioned below ball element 46. Thus the ball seat 62 is formed on the lower, or below ball, side of the ball element 46. Ball element 46 is rotatable in relation to ball seat 62 between positions opening and closing bore 42. Ball seat 62 is the primary mechanism for preventing fluid communication across ball 46. In the prior art lubricator valve assemblies, the ball seal is formed on the top side of the ball (e.g., above ball).

A valve or ball operator 50 is connected to ball element 46 for moving the ball between an open and closed position. Operator 50 has an upper end 52 facing the above ball end of lubricator 10 and a lower end 54 facing the below ball end of lubricator 10. Open hydraulic line 32*a* is hydraulically connected to operator upper end 52 through a path 56. Similarly, close hydraulic line 32*b* is hydraulically connected to lower end 54 of operator 50 through a path 58. It is noted that operator ends 52, 54 are not open to bore 42 and therefore are not affected by the debris in the fluid in bore 42. Lubricator valve 10 may be operated between the open and closed position via hydraulic pressure transmitted through lines 32 acting on the faces of operator ends 52, 54.

In the event of a loss of hydraulic control of ball assembly 44, due to hydraulic line 32 breakage or the like, it is often necessary to establish a flow path through bore 42 and ball element 46. To establish the flow path pressure is applied from the surface into above ball portion 42*a*. Lubricator valve 10 is of a unique design to provide this pump-through functionality at various differential pressures across ball 46.

In a first example, lubricator valve 10 includes an upper, above ball, or pump-through piston 64 to provide pump-through functionality. Upper piston 64 has an end face 66 that is in fluid and pressure communication with above ball bore portion 42*a* via a passage 68. Upper piston 64 has an operator end 70 that is connected to the above ball operator end 52 of ball operator 50. In operation, pressure is provided through pipe string 16 (FIG. 1) into bore portion 42*a* and acts on ball operator 50 via upper piston 64 as shown by the arrow.

Implementation and utilization of upper piston 64 alone provides pump-through functionality at high differential pressure across ball element 46. For example, upper piston 64 alone may provide pump-through functionality for pressure differentials across ball 46 ranging from about 635 psi to 8,308 psi. It is understood and believed that the pump-through functionality is available at higher differential pressures as well.

Lubricator valve 10 may further include a lower piston 72, also referred to as a balance piston herein, to provide an expanded range of pressures for pump-through functionality. This example of lubricator valve 46 is believed to provide pump-through functionality at pressure below ball 46 ranging from zero psi to at least 12,500 psi. Additionally, the pressure differential across the valve will remain relatively low, for example 0 to 500 psi for a common size lubricator valve.

Balance piston 72 includes an end face 74 and an operator end 76. End face 74 is in fluid and pressure communication with the below ball portion of bore 42, in this example, through passage 78 as shown by the arrow. Operator end 76 is connected to lower end 54 of operator 50.

From the foregoing detailed description of specific embodiments of the invention, it should be apparent that a lubricator valve with pump-through functionality that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A lubricator valve assembly adapted for connection in a pipe string for use in a well, the assembly comprising:

a tubular valve body having a bore formed longitudinally therethrough;

a valve seat connected to the valve body and in communication with the bore, wherein the valve seat is located below a valve element relative to the top of the well, wherein the valve element is mounted in the bore and rotatable with respect to the valve seat between an open position opening the bore to fluid flow across the valve seat and a closed position blocking fluid flow at the valve seat thereby closing the bore;

an operator in connection between the valve element and a hydraulic control system, the operator moving the valve element between the open position and the closed position in response to the hydraulic control system; and means for opening the valve element upon failure of the hydraulic system, wherein the opening means comprises:

a pump-through piston having a first end connected to the operator and a second end in fluid communication with the bore on a first side of the valve element; and a counter piston having an end connected to the operator and a second end in fluid communication with the bore on a second side of the valve element opposite from the first side.

2. The assembly of claim 1, wherein the operator is not in fluid communication with the bore.

3. The assembly of claim 1, wherein the valve element is moved to the open position upon the application of pressure in the bore acting on the pump-through piston.

4. The assembly of claim 1, wherein the second end of the pump-through piston is in fluid communication with the bore on the side of the valve element opposite from the valve seat.

5. The assembly of claim 4, wherein the operator is not in fluid communication with the bore.

6. A well completion having a pipe string extending from a wellhead into a wellbore and a lubricator valve connected in the pipe string for intervening in the wellbore, the lubricator valve comprising:

a body having a longitudinal bore;

a valve seat positioned below a ball element relative to the wellhead, wherein the ball element is mounted in the bore and rotatable with respect to the valve seat between an open position opening the bore to fluid flow across the valve seat and a closed position blocking fluid flow at the valve seat thereby closing the bore; and a means for pumping-through the lubricator valve when the ball element is in the closed position, wherein the pump-through means comprises:

a pump-through piston functionally connected to the ball element and in fluid communication with the bore above the ball element; and a counter piston functionally connected to the ball element and in fluid communication with the bore below the ball element.

7. The lubricator valve of claim 6, wherein the ball element is moved to the open position in response to an above ball bore pressure.

8. The lubricator valve of claim 6, wherein the pump-through means functions to operate the ball element to the open position when a pressure differential across the ball element is in the range of 600 psi to 8,400 psi.

9. The lubricator valve of claim 6, wherein the pump-through means operates to move the ball element to the open position in response to a pressure in the bore above the ball element.

10. The lubricator valve of claim 6, wherein the pump-through means functions to move the ball element to the open position in response to a pressure in the bore above the ball element, when a pressure differential across the ball element is in the range of 300 to 500 psi and the pressure in the bore below the ball element is in the range of 0 to 12,500 psi.

11. A well completion having a pipe string extending from a wellhead into a wellbore and a lubricator valve connected in the pipe string for intervening in the wellbore, the lubricator valve comprising:

a body having longitudinal bore;

a ball element rotatably mounted in the bore;

a seal retainer connected within the body and providing a valve seat positioned below the ball element relative to the wellhead, wherein the ball element rotates with respect to the valve seat between an open position opening the bore to fluid flow across the valve seat and a closed position blocking fluid flow at the valve seat thereby closing the bore;

an operator in connection between the ball element and a hydraulic control system, the operator moving the ball element between the open position and the closed position in response to the hydraulic control system, the operator not in fluid communication with the bore;

a pump-through piston having a first end connected to the operator and a second end in fluid communication with the bore above the ball element; and a counter piston having an end connected to the operator and a second end in fluid communication with the bore below the ball element.

12. The well completion of claim 11, wherein the pump-through piston functions to move the ball element to the open position when a pressure differential across the ball element is in the range of about 600 psi to 8,400 psi.

13. The well completion of claim 11, wherein the pump-through piston and the counter piston function to move the ball element to the open position when a pressure differential across the ball element is in the range of about 300 psi to 500 psi.

14. The well completion of claim 11, wherein the pump-through piston and the counter piston function to move the ball element to the open position in response to a pressure in the bore above the ball element, when a pressure differential across the ball element is in the range of 300 to 500 psi and the pressure in the bore below the ball element is in the range of 0 to 12,500 psi.

15. The well completion of claim 11, wherein the pump-through piston functions to move the ball element to the open position in response to a pressure in the bore above the ball element.

* * * * *